US011517935B1

(12) United States Patent
Li et al.

(10) Patent No.: US 11,517,935 B1
(45) Date of Patent: Dec. 6, 2022

(54) CAULKING GUN HANDLE AND CAULKING GUN

(71) Applicant: TIANJIN JINMAO GROUP CO., LTD, Tianjin (CN)

(72) Inventors: Jie Li, Tianjin (CN); Shengjiang Wang, Tianjin (CN); Fengming Li, Tianjin (CN)

(73) Assignee: TIANJIN JINMAO GROUP CO., LTD, Tianjin (CN)

( * ) Notice: Subject to any disclaimer, the term of this patent is extended or adjusted under 35 U.S.C. 154(b) by 0 days.

(21) Appl. No.: 17/539,327

(22) Filed: Dec. 1, 2021

(51) Int. Cl.
*B05C 17/01* (2006.01)

(52) U.S. Cl.
CPC ..... *B05C 17/0133* (2013.01)

(58) Field of Classification Search
CPC . B05C 17/01; B05C 17/0116; B05C 17/0123; B05C 17/0126; B05C 17/0136
See application file for complete search history.

(56) References Cited

U.S. PATENT DOCUMENTS 2,732,102 A * 1/1956 Ekins ..... G01F 11/026 222/391
7,011,238 B1 * 3/2006 Sung ..... B05C 17/0123 222/391
10,569,295 B1 * 2/2020 Hung ..... B05C 17/0126
10,668,498 B1 * 6/2020 Hung ..... B05C 17/00596
11,253,887 B1 * 2/2022 Hung ..... B05C 17/0123
2008/0047983 A1 * 2/2008 Beckett ..... B05C 17/01 222/391
2009/0134187 A1 * 5/2009 Hefele ..... B05C 17/0126 222/391
2010/0237105 A1 * 9/2010 Zagone ..... B05C 17/0126 222/391
2013/0161361 A1 * 6/2013 Szpak ..... B26D 3/169 222/391
2014/0263469 A1 * 9/2014 Lee ..... B05C 17/00576 222/391
2015/0053717 A1 * 2/2015 Williams ..... B05B 11/02 222/326
2017/0165707 A1 * 6/2017 Hung ..... B05C 17/00596

* cited by examiner

*Primary Examiner* — Donnell A Long
(74) *Attorney, Agent, or Firm* — Casimir Jones, S.C.; Tanya A. Arenson

(57) ABSTRACT

A caulking gun handle and a caulking gun are provided. A caulking amount adjusting assembly is mounted on a movable handle of the caulking gun; the caulking amount adjusting assembly comprises a driving shaft and a driving shaft positioning member; portions at two sides of a mounting groove are each formed as a handle mounting portion; a driving protrusion and first and second positioning recesses are provided on a peripheral surface of the driving shaft, the driving shaft can slide left and right with respect to the two handle mounting portions, so that in a first workstation, an end portion of the driving shaft positioning member located in the driving shaft mounting hole is engaged in the first positioning recess, and in a second workstation, the end portion of the driving shaft positioning member located in the driving shaft mounting hole is engaged in the second positioning recess.

20 Claims, 10 Drawing Sheets

CAULKING GUN HANDLE AND CAULKING GUN

CROSS-REFERENCE TO RELATED APPLICATION

The present disclosure claims the priority to the Chinese patent application with the filing No. 2021111888350, filed on Oct. 12, 2021 with the Chinese Patent Office, and entitled "Caulking Gun Handle and Caulking Gun", the contents of which are incorporated by reference herein in entirety.

TECHNICAL FIELD

The present disclosure relates to the technical field of caulking tools, in particular to a caulking gun handle and a caulking gun.

BACKGROUND ART

In the prior art, when a caulking gun is used for caulking, the amount of caulking discharged from the caulk cartridge cannot be controlled, and the propelling ratio of the caulking gun cannot be flexibly adjusted according to different viscosities of the caulks, thus leading to a too large caulking amount in some work scenes, which on the one hand will cause great interference to the process, and needs additionally performing cleaning work to excess caulk discharged on the to-be-caulked surface, and on the other hand, also causes a problem of serious caulk waste. In some work scenes, the caulking amount at a single time is too small, resulting in that the caulking needs to be performed multiple times to cover the to-be-caulked surface, and then causing a problem that the caulking efficiency is low and further the construction efficiency is affected.

SUMMARY

An embodiment of the present disclosure provides a caulking gun handle, including a top connector, a locking sheet, a caulking gun ejector rod, a driving block, a driving spring, a fixed handle, and a movable handle; the locking sheet is obliquely connected to a rear end of the top connector by a spring, the caulking gun ejector rod penetrates through the locking sheet and the top connector; the driving block is slidably connected to the caulking gun ejector rod; the driving spring is sleeved over the caulking gun ejector rod, one end of the driving spring abuts against a front end face of the driving block, and the other end of the driving spring is configured to abut against a barrel of the caulking gun; an upper end of the fixed handle is fixedly connected to a lower end of the top connector; an upper end of the movable handle is pivoted inside the top connector, and the movable handle is located in front of the fixed handle; the driving block is hinged with the upper end of the movable handle or a lower end of the driving block abuts against a front side of the upper end of the movable handle.

In the above, a caulking amount adjusting assembly is mounted on the movable handle;

the caulking amount adjusting assembly includes a driving shaft and a driving shaft positioning member;

the upper end of the movable handle is provided with a mounting groove, parts at two sides of the mounting groove are each formed as a handle mounting portion, and the two handle mounting portions are provided at left and right sides of the top connector respectively; the top connector is provided with a first pivot rotating shaft mounting hole that passes through the top connector in a left-right direction, the two handle mounting portions are each provided with a driving shaft mounting hole that passes through the handle mounting portions in the left-right direction, the driving shaft sequentially penetrates through the driving shaft mounting hole in one of the handle mounting portions, the first pivot rotating shaft mounting hole, and the driving shaft mounting hole in the other one of the handle mounting portions, two ends of the driving shaft are each provided with an anti-release structure, and the driving shaft rotates in synchronization with the two handle mounting portions;

a portion of the driving shaft is provided with a driving protrusion, a first positioning recess, and a second positioning recess, with the portion located at a peripheral surface of the driving shaft and between the two handle mounting portions; a positioning member mounting hole is provided on at least one of the handle mounting portions, the positioning member mounting hole is in communication with the driving shaft mounting hole, the driving shaft positioning member is mounted in the positioning member mounting hole, and one end of the driving shaft positioning member extends into the driving shaft mounting hole; and the driving shaft is capable of sliding left and right with respect to the two handle mounting portions, so that in a first workstation, an end portion of the driving shaft positioning member located in the driving shaft mounting hole is engaged in the first positioning recess, and in a second workstation, the end portion of the driving shaft positioning member located in the driving shaft mounting hole is engaged in the second positioning recess; with the driving shaft being in the first workstation, one end of the driving protrusion away from the driving shaft is capable of pressing the driving block forward while the driving shaft rotates forward; and with the driving shaft being in the second workstation, the driving protrusion avoids the driving block.

In one or more embodiment, the driving shaft positioning member is a ball point screw (bead screw), a ball point end of the ball point screw extends into the driving shaft mounting hole, and the positioning member mounting hole is a threaded hole.

In one or more embodiment, the driving shaft includes a main shaft and a shaft sleeve, the main shaft includes a first shaft segment and a second shaft segment integrally connected with each other, and an outer circle diameter of a radial section of the first shaft segment is greater than an outer circle diameter of a radial section of the second shaft segment;

the first positioning recess and the second positioning recess are provided on a peripheral surface of the first shaft segment; the driving protrusion is cam-shaped, both the driving protrusion and the shaft sleeve are sleeved outside the second shaft segment, one side surface of the driving protrusion abuts against an end face of one end of the first shaft segment facing the second shaft segment, and the other side surface of the driving protrusion abuts against an end face of one end of the shaft sleeve facing the first shaft segment; and one end of the first shaft segment away from the second shaft segment is inserted in the driving shaft mounting hole of one of the handle mounting portions, one end of the second shaft segment away from the first shaft segment and one end of the shaft sleeve away from the first shaft segment are both inserted in the driving shaft mounting hole of the other one of the handle mounting portions, and the anti-release structure is capable of preventing the driving shaft and the shaft sleeve from disengaging from the corresponding driving shaft mounting holes.

In one or more embodiment, the peripheral surface of the driving shaft is provided with a plane, and the first positioning recess, the second positioning recess, and the driving protrusion are all provided in the plane; and a hole wall of the driving shaft mounting hole fits to and is matched with the peripheral surface of the driving shaft.

In one or more embodiment, the driving protrusion is fixedly connected or integrally molded to a peripheral surface of one end of the driving shaft, and the first positioning recess and the second positioning recess are both provided at the driving protrusion; and the driving protrusion is inserted into the driving shaft mounting hole of one of the handle mounting portions, and an end of the driving shaft away from the driving protrusion is inserted into the driving shaft mounting hole of the other one of the handle mounting portions; the anti-release structure is capable of preventing the driving shaft and the driving protrusion from disengaging from the corresponding driving shaft mounting holes.

In one or more embodiment, an end face of one end of the driving protrusion away from the driving shaft is a circular arc surface; and/or one side of one of the handle mounting portions facing the other one of the handle mounting portions is provided with an avoidance groove for avoiding the driving shaft positioning member.

In one or more embodiment, the anti-release structure includes a screw and a baffle; the baffle is sleeved over the screw, and one end of the screw is inserted and threaded into a threaded hole provided in an end surface of the driving shaft.

In one or more embodiment, a pivot rotating shaft is further connected between the two handle mounting portions, the pivot rotating shaft penetrates through the first pivot rotating shaft mounting hole in the top connector, one end of the pivot rotating shaft is rotatably connected to one of the handle mounting portions, and the other end of the pivot rotating shaft is rotatably connected to the other one of the handle mounting portions.

In one or more embodiment, the two handle mounting portions are each provided with a second pivot rotating shaft mounting hole;

the pivot rotating shaft includes a head portion and a rod portion, and the rod portion of the pivot rotating shaft is blocked and locked by an end stopper after sequentially penetrating through the second pivot rotating shaft mounting hole in one of the handle mounting portions, the first pivot rotating shaft mounting hole in the top connector, and the second pivot rotating shaft mounting hole in the other one of the handle mounting portions; alternatively, two ends of the pivot rotating shaft are each blocked and locked by an end stopper after the pivot rotating shaft sequentially penetrates through the second pivot rotating shaft mounting hole in one of the handle mounting portions, the first pivot rotating shaft mounting hole in the top connector, and the second pivot rotating shaft mounting hole in the other one of the handle mounting portions.

In one or more embodiment, the end stopper is an elastic retaining ring.

In one or more embodiment, the elastic retaining ring is provided with a central opening, and a first slit, a hole, and a second slit in communication with the central opening, wherein a portion of the elastic retaining ring close to the first slit extends upwards to the second slit so as to form the hole.

An embodiment of the present disclosure further provides a caulking gun, including a barrel and the caulking gun handle according to any one of the preceding embodiments.

As the caulking gun provided in the second aspect of the embodiment of the present disclosure includes the caulking gun handle provided in the first aspect, the caulking gun provided in the second aspect of the embodiment of the present disclosure can achieve all the beneficial effects that can be achieved by the caulking gun handle provided in the first aspect.

BRIEF DESCRIPTION OF DRAWINGS

In order to more clearly illustrate the technical solutions in specific embodiments of the present disclosure or in the prior art, drawings which need to be used in the description of the specific embodiments or the prior art will be introduced briefly below, and apparently, the drawings in the description below merely show some embodiments of the present disclosure, and a person ordinarily skilled in the art still could obtain other drawings in light of these drawings without creative efforts.

Figure 1:
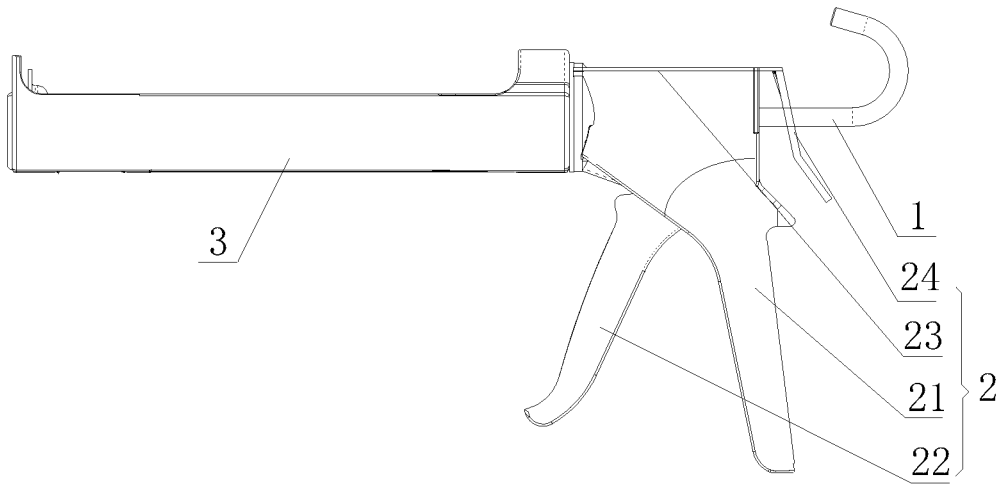
FIG. 1 is a schematic view of an overall structure of a caulking gun in the prior art.

Reference signs: 1—caulking gun ejector rod; 2—caulking gun handle; 21—fixed handle; 22—movable handle; 221—driving shaft mounting hole; 222—positioning member mounting hole; 223—avoidance groove; 224—second pivot rotating shaft mounting hole; 225—mounting groove; 226—handle mounting portion; 23—top connector; 231—penetration mounting hole; 232—first pivot rotating shaft mounting hole; 24—locking sheet; 3—barrel; 4—driving block; 5—driving spring; 100—caulking amount adjusting assembly; 110—driving shaft; 111—main shaft; 1111—first shaft segment; 1112—second shaft segment; 112—shaft sleeve; 1101—driving protrusion; 1102—first positioning recess; 1103—second positioning recess; 120—driving shaft positioning member; 300—anti-release structure; 310—screw; 320—baffle; 400—pivot rotating shaft; 401—head portion; 402—rod portion; 410—end stopper; 411—central opening; 412—slit; 413—hole.

DETAILED DESCRIPTION OF EMBODIMENTS

In order to make objectives, technical solutions, and advantages of the embodiments of the present disclosure clearer, the technical solutions in the embodiments of the present disclosure will be described clearly and completely below in conjunction with the accompanying drawings in the embodiments of the present disclosure, and apparently, some but not all embodiments of the present disclosure are described. Generally, components in the embodiments of the present disclosure described and shown in the accompanying drawings herein may be arranged and designed in different configurations.

Therefore, the detailed description below of the embodiments of the present disclosure provided in the accompanying drawings is not intended to limit the scope of protection of the present disclosure, but merely represents chosen embodiments of the present disclosure. Based on the embodiments in the present disclosure, all of other embodiments, obtained by those ordinarily skilled in the art without any creative effort, shall fall within the scope of protection of the present disclosure.

It should be noted that similar reference signs and letters represent similar items in the following accompanying drawings, therefore, once a certain item is defined in one accompanying drawing, it is not needed to be further defined or explained in subsequent accompanying drawings.

In the description of the present disclosure, it should be noted that orientation or positional relationships indicated by terms such as "front", "back", "left", "right", "inner", and "outer", are based on orientation or positional relationships as shown in the drawings, or orientation or positional relationships of a product of the present disclosure when being conventionally placed in use, merely for facilitating describing the present disclosure and simplifying the description, rather than indicating or suggesting that related devices or elements have to be in the specific orientation or configured and operated in a specific orientation, therefore, they should not be construed as limitation to the present disclosure. Besides, terms such as "first" and "second" are merely used for distinctive description, but should not be construed as indicating or implying importance in the relativity.

In the description of the present disclosure, it should be further illustrated that, unless otherwise clearly specified and defined, the terms "provide", "install", and "connect" should be understood in a broad sense, for example, a connection may be a fixed connection, a detachable connection, or an integrated connection; it may be a mechanical connection or an electrical connection; it may be direct joining or indirect joining through an intermediate media, and it also may be inner communication between two elements. For a person ordinarily skilled in the art, specific meanings of the above-mentioned terms in the present disclosure could be understood according to specific circumstances.

Some embodiments of the present disclosure are described in detail below in combination with the drawings. The following embodiments and features in the embodiments may be combined with each other without conflict.

The caulking gun handle and the caulking gun provided in the present disclosure alleviate the technical problems in the prior art that when the caulking gun is used for caulking, the amount of caulk discharged from the caulk cartridge cannot be controlled, and the caulking cannot be flexibly performed in different strengths according to different caulk viscosities.

Embodiment 1

Figure 2:
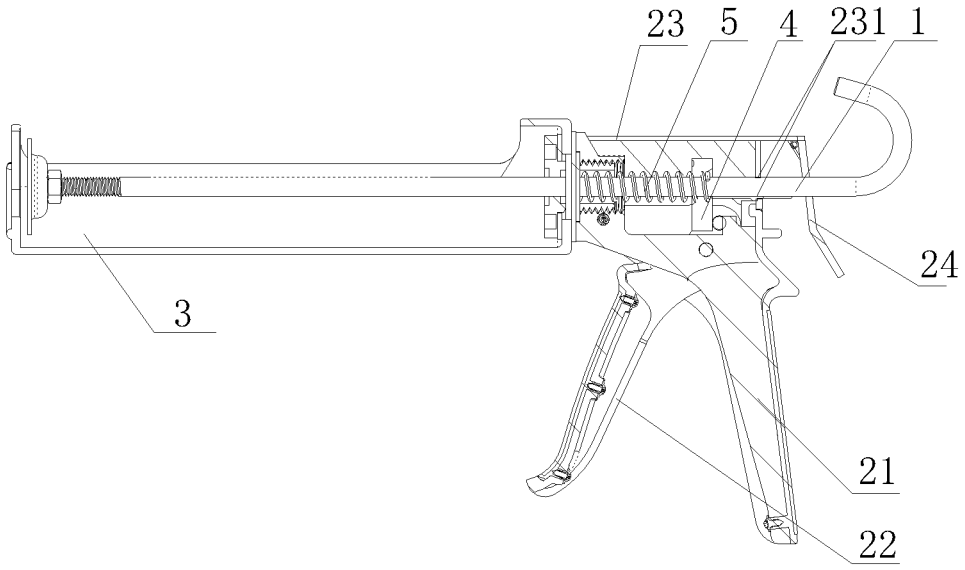
FIG. 2 is a sectional view of the overall structure of the caulking gun in the prior art.
Figure 3:
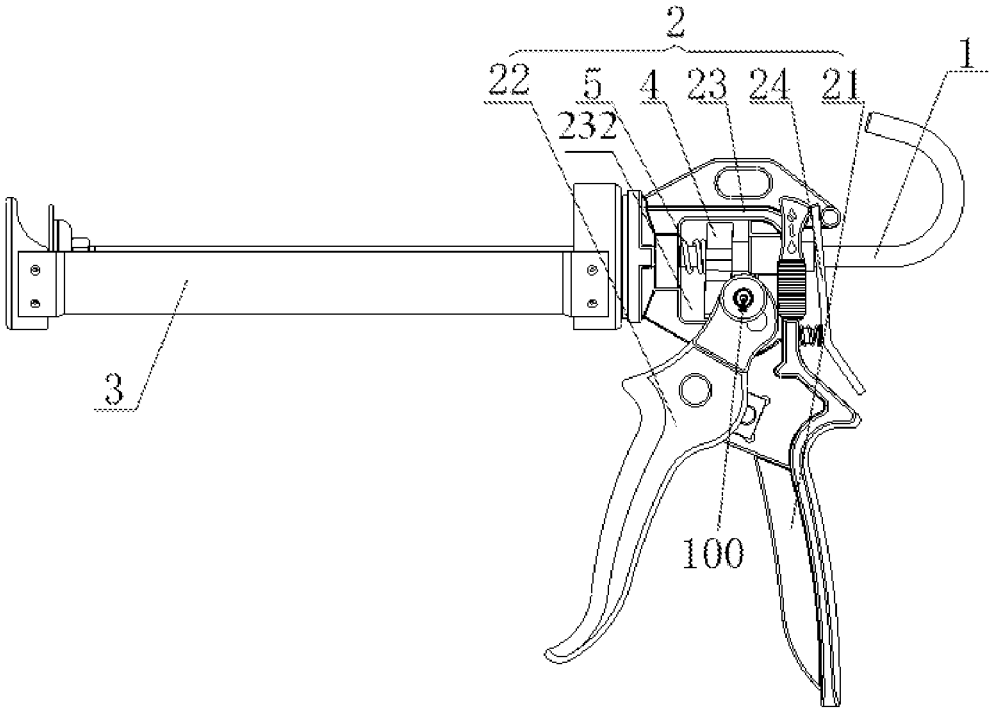
FIG. 3 is side view of an overall structure of a caulking gun mounted with a caulking gun handle provided in an embodiment of the present disclosure.
Figure 4:
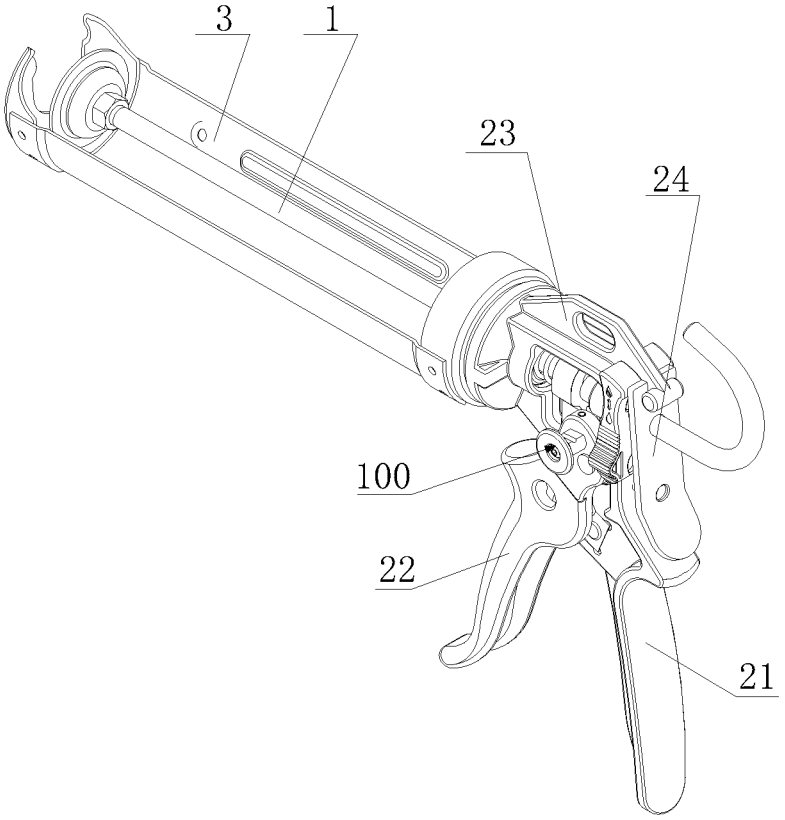
FIG. 4 is an isometric view of the overall structure of the caulking gun shown in FIG. 3.
Figure 5:
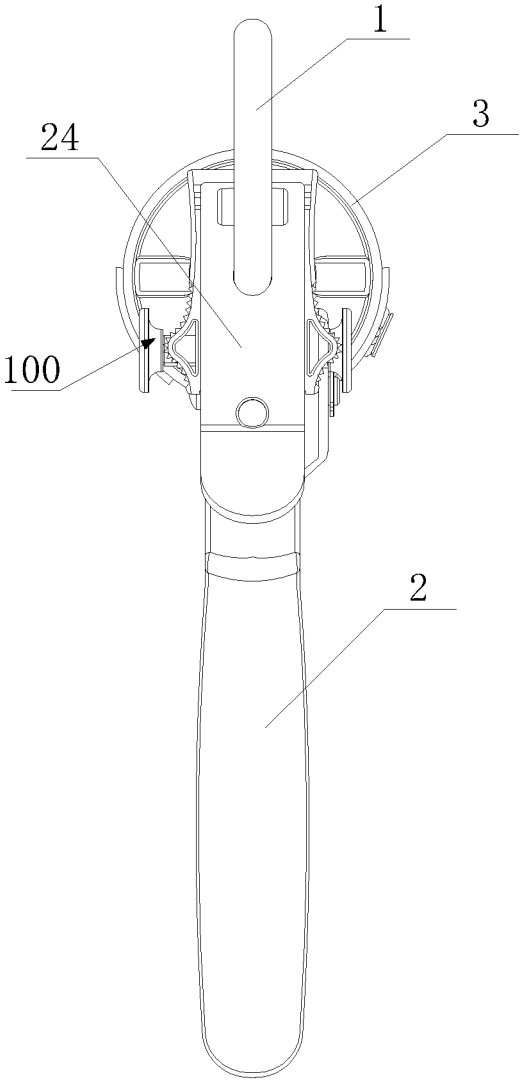
FIG. 5 is a rear view of the caulking gun shown in FIG. 3.

The caulking gun is a caulking tool, and as shown in FIG. 1 and FIG. 2, the caulking gun used at present includes a caulking gun ejector rod 1, a caulking gun handle 2, and a barrel 3 connected to a front end of the caulking gun handle 2. The caulking gun handle 2 includes a fixed handle 21, a movable handle 22, and a top connector 23 having a penetration mounting hole 231 for allowing the caulking gun ejector rod 1 to penetrate therethrough and be mounted; an upper end of the fixed handle 21 is fixedly connected to a lower end of the top connector 23, wherein the fixed handle 21 may be fixedly connected to the lower end of the top connector 23 through a screw, a rivet or other fasteners, or may be in an integrally molded structure with the top connector 23; an upper end of the movable handle 22 is pivoted inside the top connector 23, and the movable handle 22 is located in front of the fixed handle 21; the caulking gun handle 2 further includes a locking sheet 24 obliquely hinged to a rear end of the top connector 23 by a spring, the locking sheet 24 is provided with a through hole (penetration hole), the caulking gun ejector rod 1 penetrates through the penetration mounting hole 231 in the top connector 23 and the through hole in the locking sheet 24, and the caulking gun ejector rod 1 has a rear end located outside the top connector 23, and a front end extending into inside of the barrel 3; the caulking gun ejector rod 1 is slidably provided with a driving block 4; the driving block 4 is hinged with the upper end of the movable handle 22, or a lower end of the driving block 4 abuts against a front side of the upper end of the movable handle 22, a driving spring 5 is further sleeved over the caulking gun ejector rod 1, and the driving spring 5 has one end abutting against the driving block 4, and the other end abutting against the barrel 3, wherein a manner in which one end of the driving spring 5 close to the barrel 3 abuts against the barrel 3 includes but is not limited to that a rear end of the barrel 3 is provided with a sleeve-shaped connecting portion having a peripheral surface provided with a thread, a front end of the top connector 23 is sleeved over and threaded to the outside of the connecting portion, the caulking gun ejector rod 1 penetrates through the connecting portion, and one end of the driving spring 5 close to the barrel 3 extends into the inside of the connecting portion and abuts against a rear end face of the barrel 3; and the caulking gun ejector rod 1 is locked in the through hole of the locking sheet 24 under the effect of the spring between the locking sheet 24 and the top connector 23.

In specific use, the locking sheet 24 is pressed so that the locking sheet 24 extends along a vertical direction to release the caulking gun ejector rod 1, the caulking gun ejector rod 1 is pulled to enable the front end of the caulking gun ejector rod 1 to move backward and then release the locking sheet 24, the caulk cartridge is placed inside the barrel 3 with a caulk outlet facing forward, the movable handle 22 is pulled backward, at this time, the upper end of the movable handle 22 can enable the driving block 4 to incline so that the driving block 4 locks the caulking gun ejector rod 1, meanwhile, the upper end of the movable handle 22 pushes the driving block 4 to move forward so as to drive the caulking gun ejector rod 1 to move forward against the friction force between the through hole of the locking sheet 24 and the caulking gun ejector rod 1, the front end of the caulking gun ejector rod 1 is enabled to be squeezed and placed in a rear end of the caulk cartridge inside the barrel 3, to make the caulk discharged from the caulk cartridge; during the forward movement, the driving block 4 will compress the driving spring 5, and the driving spring 5 allows the driving block 4 and the movable handle 22 to always have a movement trend of returning, so that the driving block 4 restores and returns to a normal position when the movable handle 22 is released, which operations are repeated to performing the caulking.

In the prior art, when the caulking gun is used for caulking, the amount of the caulk discharged from the caulk cartridge cannot be controlled, thus leading to a too large caulking amount in some work scenes, which on the one hand will cause great interference to the process, and needs extra cleaning work for excess caulk discharged on the to-be-caulked surface, and on the other hand, also causes a problem of serious caulk waste. In some work scenes, the caulking amount at a single time is too small, and the caulking needs to be performed multiple times to cover the to-be-caulked surface, then causing a problem that the caulking efficiency is low and further the construction efficiency is affected. Moreover, the propelling ratio of the caulking gun in the prior art cannot be adjusted according to different caulk viscosities, then in some work scenes with high caulk viscosity, as the propelling ratio of the caulking gun cannot be decreased by adjustment, the caulking amount will be too large, extra cleaning work needs to be performed on excess caulk discharged on the to-be-caulked surface, thus causing great interference to the process, and meanwhile also causing serious caulk waste; and in some work scenes with low caulk viscosity, as the propelling ratio of the caulking gun cannot be increased by adjustment, the caulking amount at a single time is too small, the caulking needs to be performed multiple times to cover the to-be-caulked surface, then the caulking efficiency is low and further the construction efficiency is affected. Compared with the caulking guns in the prior art, the present disclosure provides an improved caulking gun, i.e. a caulking gun mounted with a caulking gun handle according to the present disclosure, as shown in FIG. 3 to FIG. 12.

As shown in FIG. 3 to FIG. 12, the caulking gun in the present disclosure includes a caulking gun handle 2 and a barrel 3 connected to a front end of the caulking gun handle 2, the caulking gun handle 2 includes a caulking gun ejector rod 1, a fixed handle 21, a movable handle 22, a top connector 23, a locking sheet 24, a driving block 4, and a driving spring 5, wherein the locking sheet 24 is obliquely hinged to a rear end of the top connector 23 by a spring, and the caulking gun ejector rod 1 penetrates through the locking sheet 24 and the top connector 23; the driving block 4 is slidably connected to the caulking gun ejector rod 1; the driving spring 5 is sleeved over the caulking gun ejector rod 1, the driving spring 5 has one end abutting against a front end face of the driving block 4, and the other end configured to abut against the barrel 3 of the caulking gun; an upper end of the fixed handle 21 is fixedly connected to a lower end of the top connector 23; an upper end of the movable handle 22 is pivoted in the top connector 23, and the movable handle 22 is located in front of the fixed handle 21; the driving block 4 is hinged with the upper end of the movable handle 22 or a lower end of the driving block 4 abuts against a front side of the upper end of the movable handle 22.

In the structure of the caulking gun handle 2 according to the present disclosure, a caulking amount adjusting assembly 100 is mounted on the movable handle 22, and the caulking amount and the propelling ratio of the caulking gun may be adjusted by the caulking amount adjusting assembly 100.

Referring particularly to FIG. 6 to FIG. 9, specifically, the caulking amount adjusting assembly 100 includes a driving shaft 110 and a driving shaft positioning member 120; the upper end of the movable handle 22 is provided with a mounting groove 225, and parts at two sides of the mounting groove are each formed as a handle mounting portion 226, and the two handle mounting portions 226 are provided on both left and right sides of the top connector 23, respectively; the top connector 23 is provided with a first pivot rotating shaft mounting hole 232 that passes through the top connector 23 in a left-right direction, the two handle mounting portions 226 are respectively provided with a driving shaft mounting hole 221 that passes through the handle mounting portions 226 in the left-right direction, the driving shaft 110 sequentially penetrates through the driving shaft mounting hole 221 in one handle mounting portion 226, the first pivot rotating shaft mounting hole 232, and the driving shaft mounting hole 221 in the other handle mounting portion 226, two ends of the driving shaft 110 are both provided with an anti-release structure 300, and the driving shaft 110 rotates in synchronization with the two handle mounting portions 226. A driving protrusion 1101, a first positioning recess 1102, and a second positioning recess 1103 are provided on a peripheral surface of the driving shaft 110 and between the two handle mounting portions 226; at least one of the handle mounting portions 226 is provided with a positioning member mounting hole 222, the positioning member mounting hole 222 is in communication with the driving shaft mounting hole 221, the driving shaft positioning member 120 is mounted in the positioning member mounting hole 222, and one end of the driving shaft positioning member 120 extends into the driving shaft mounting hole 221. The driving shaft 110 can slide left and right with respect to the two handle mounting portions, so that in the first workstation, an end portion of the driving shaft positioning member 120 located in the driving shaft mounting hole 221 is engaged in the first positioning recess 1102, and in a second workstation, the end portion of the driving shaft positioning member 120 located in the driving shaft mounting hole 221 is engaged in the second positioning recess 1103; with the driving shaft 110 being in the first workstation, one end of the driving protrusion 1101 away from the driving shaft 110 can press the driving block 4 forward while the driving shaft 110 rotates forward; and with the driving shaft 110 being in the second workstation, the driving protrusion 1101 avoids the driving block 4.

Figure 6:
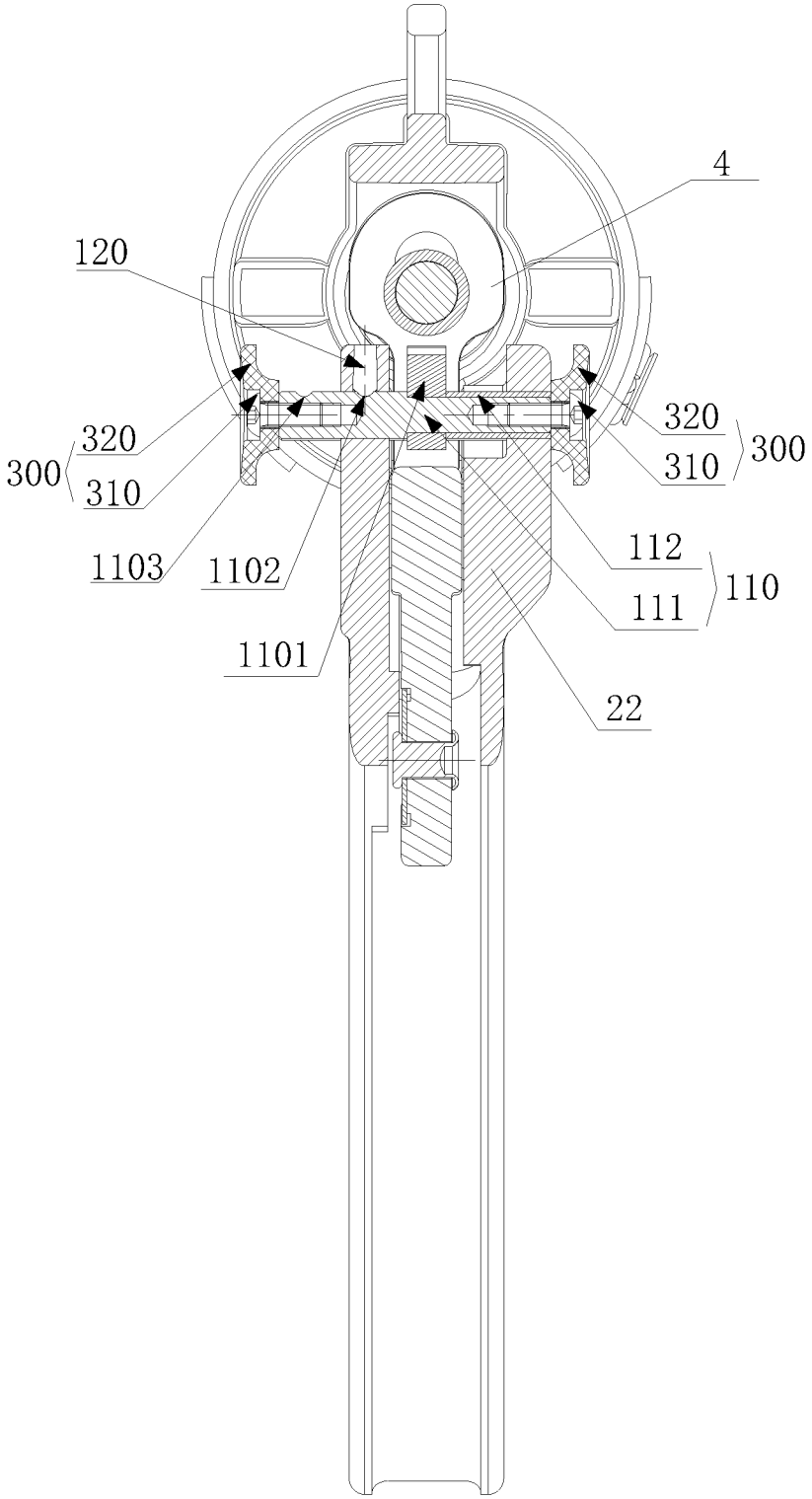
FIG. 6 is a structural sectional view when a driving shaft in FIG. 5 is located in a first workstation.
Figure 7:
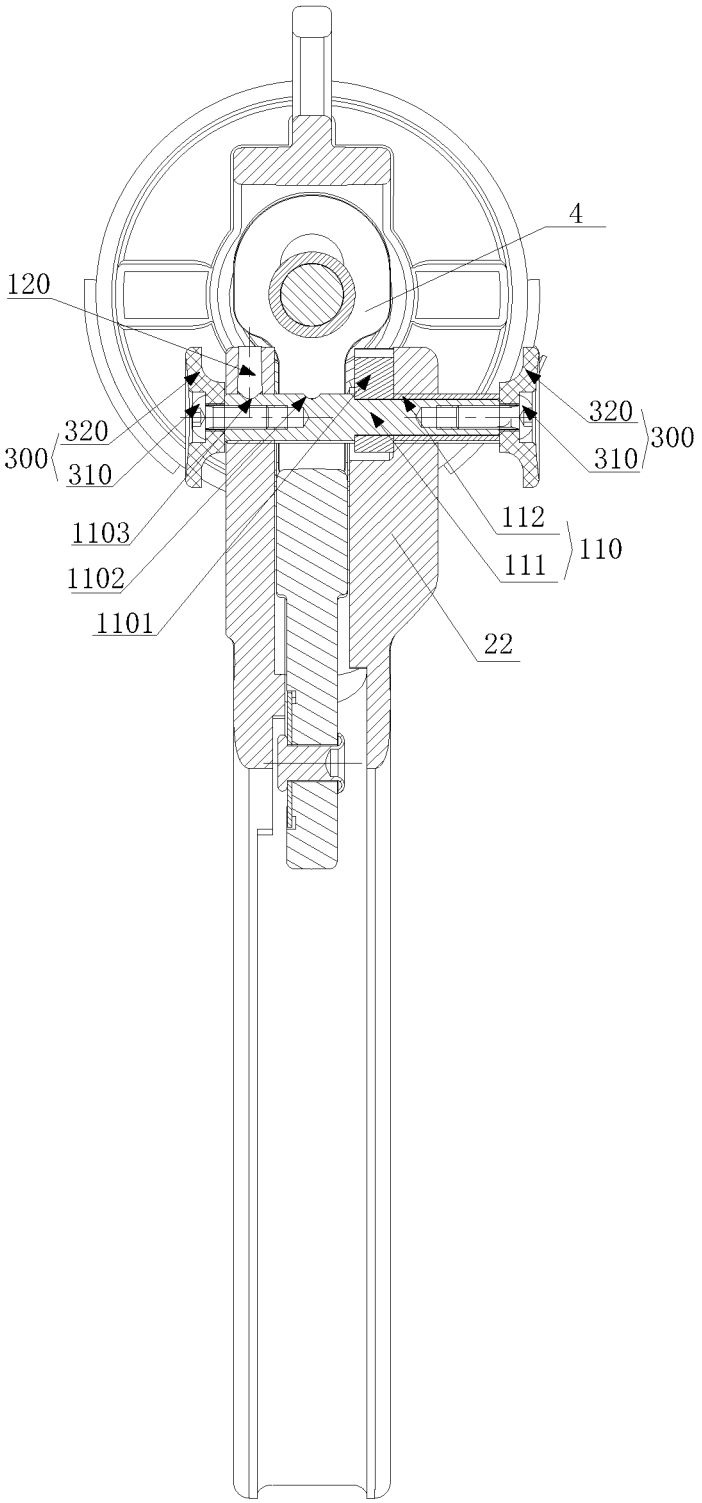
FIG. 7 is a structural sectional view when the driving shaft in FIG. 5 is located in a second workstation.

The structure of the caulking gun handle provided in the present embodiment has two working conditions:

The first working condition is applicable to cases where a large caulking amount is required or the caulk viscosity is low. As shown in FIG. 6, the operator pushes the driving shaft 110 to enable the driving shaft 110 to be located in the first workstation in the above, that is, the end portion of the driving shaft positioning member 120 located in the driving shaft mounting hole 221 is engaged in the first positioning recess 1102, at this time, the end of the driving protrusion 1101 away from the driving shaft 110 can press the driving block 4 forward while the driving shaft 110 rotates forward, and when the driving shaft 110 is in contact with the driving block 4, the propelling ratio is larger, and the caulking amount is larger, which is suitable for applying the caulk with relatively low viscosity;

The second working condition is applicable to cases where a small caulking amount is required or the caulk viscosity is high. As shown in FIG. 7, the operator pushes the driving shaft 110 reversely to enable the driving shaft 110 to be located in the second workstation in the above, that is, the end portion of the driving shaft positioning member 120 located in the driving shaft mounting hole 221 is engaged in the second positioning recess 1103, at this time, the driving protrusion 1101 avoids the driving block 4, and when the driving shaft 110 is in contact with the driving block 4, the propelling ratio is smaller and the caulking amount is smaller, which is suitable for applying the caulk with relatively high viscosity.

In the present embodiment, by mounting the caulking amount adjusting assembly 100 on the movable handle 22 of the caulking gun, the function of changing gear position of the propelling ratio is realized, and the caulking feed amount of the caulking gun is changed, thus the actual caulking amount of the caulking gun may be adjusted according to actual needs, ensuring the construction process while avoiding extra cleaning work, having the effect of saving caulk, and being more beneficial to quick construction.

In some optional examples of the present embodiment, the driving shaft positioning member 120 is a ball point screw, a ball point end of the ball point screw extends into the driving shaft mounting hole 221, the positioning member mounting hole 222 is a threaded hole, the ball point screw is threaded in the positioning member mounting hole 222, and when the driving shaft 110 is pushed left and right, the ball point end may be quickly embedded into or exits the first positioning recess 1102 or the second positioning recess 1103 under the effect of pushing force.

Figure 9:
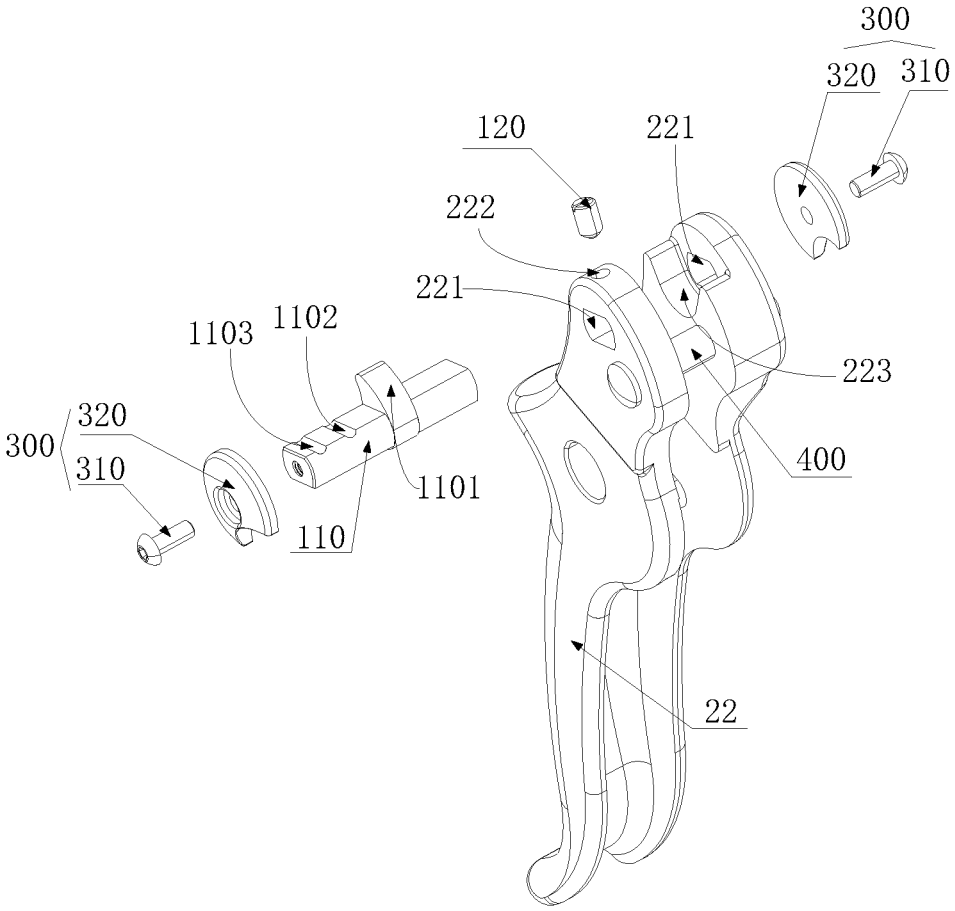
FIG. 9 is an exploded view of an assembly structure of the movable handle and the caulking amount adjusting assembly in FIG. 8.
Figure 10:
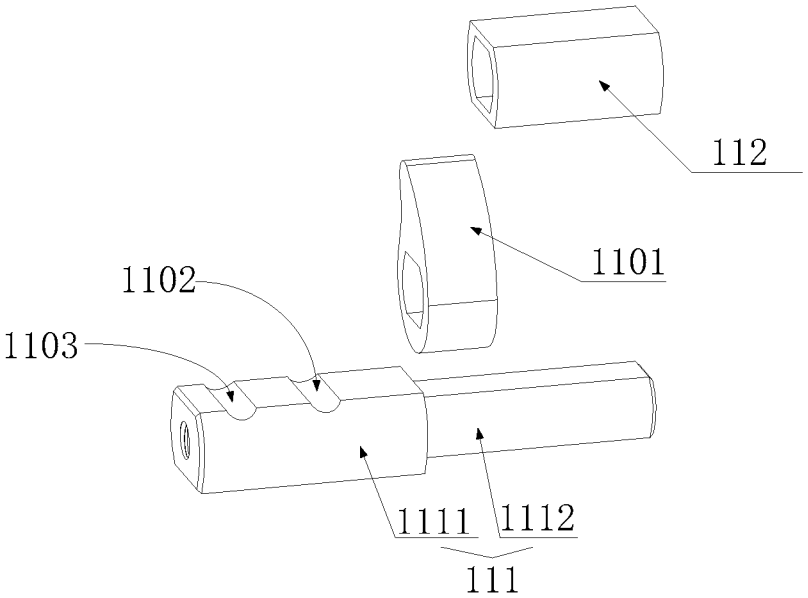
FIG. 10 is an exploded structural view of the driving shaft in FIG. 8.

In some optional examples of the present embodiment, as a caulking gun handle, as shown in FIG. 10, in conjunction with FIG. 9, the driving shaft 110 includes a main shaft 111 and a shaft sleeve 112, the main shaft 111 includes a first shaft segment 1111 and a second shaft segment 1112 integrally connected with each other, and an outer circle diameter of a radial section of the first shaft segment 1111 is greater than an outer circle diameter of a radial section of the second shaft segment 1112. In the above, the first positioning recess 1102 and the second positioning recess 1103 are provided on a peripheral surface of the first shaft segment 1111; the driving protrusion 1101 is cam-shaped, both the driving protrusion 1101 and the shaft sleeve 112 are sleeved outside the second shaft segment 1112, one side surface of the driving protrusion 1101 abuts against an end face of one end of the first shaft segment 1111 facing the second shaft segment 1112, the other side surface of the driving protrusion 1101 abuts against an end face of one end of the shaft sleeve 112 facing the first shaft segment 1111. One end of the first shaft segment 1111 away from the second shaft segment 1112 is inserted in the driving shaft mounting hole 221 of one handle mounting portion, one end of the second shaft segment 1112 away from the first shaft segment 1111 and one end of the shaft sleeve 112 away from the first shaft segment 1111 are both inserted in the driving shaft mounting hole 221 of the other handle mounting portion, and the anti-release structure 300 can prevent the driving shaft 110 and the shaft sleeve 112 from disengaging from the corresponding driving shaft mounting holes 221.

With continued reference to FIG. 9 and FIG. 10, in these optional embodiments, preferably, but not limited to, the peripheral surface of the driving shaft 110 is provided with a plane, and the first positioning recess 1102, the second positioning recess 1103, and the driving protrusion 1101 are all provided at the foregoing plane; a hole wall of the driving shaft mounting hole 221 fits to and is matched with the peripheral surface of the driving shaft 110, so as to realize synchronous rotation of the driving shaft 110 with the two handle mounting portions of the movable handle 22.

Figure 13:
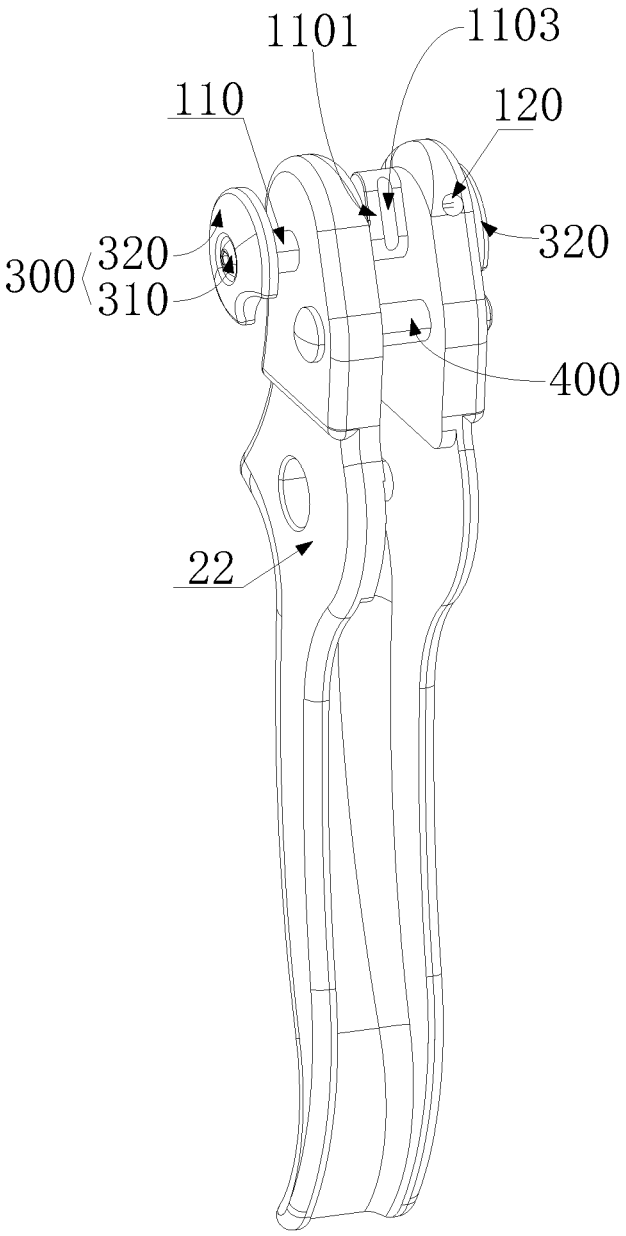
FIG. 13 is an isometric view of the assembly structure of the movable handle and the caulking amount adjusting assembly in another caulking gun handle provided in an embodiment of the present disclosure.
Figure 14:
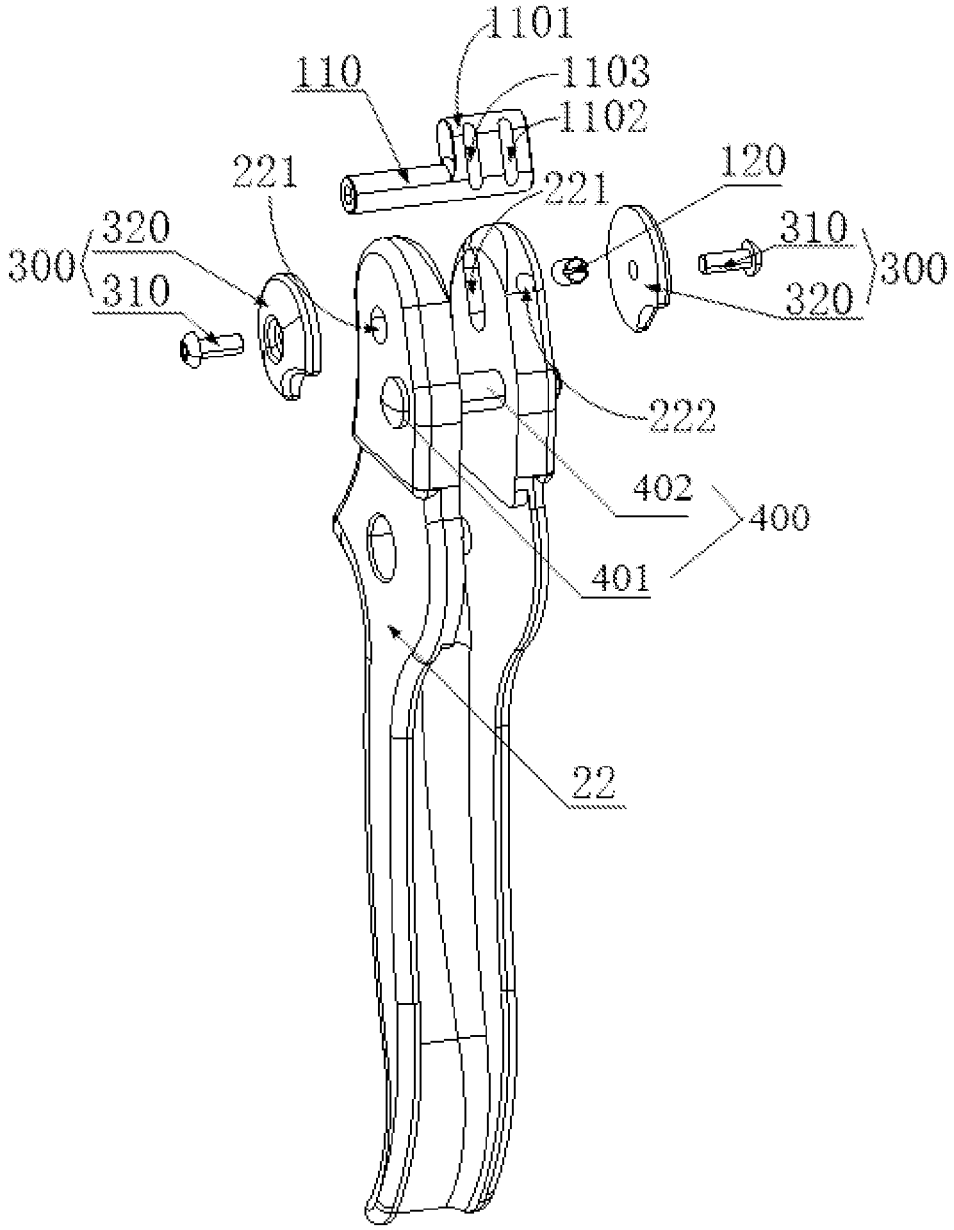
FIG. 14 is an exploded view of the assembly structure of the movable handle and the caulking amount adjusting assembly in FIG. 13.

In some other optional examples of the present embodiment, as another caulking gun handle, referring to FIG. 13 and FIG. 14, the driving protrusion 1101 is fixedly connected or integrally molded to a peripheral surface of one end of the driving shaft 110, and the first positioning recess 1102 and the second positioning recess 1103 are both provided at the driving protrusion 1101; the driving protrusion 1101 is inserted into the driving shaft mounting hole 221 of one handle mounting portion 226, and an end of the driving shaft 110 away from the driving protrusion 1101 is inserted into the driving shaft mounting hole 221 of the other handle mounting portion 226; and the anti-release structure 300 can prevent the driving shaft 110 and the driving protrusion 1101 from disengaging from the corresponding driving shaft mounting holes 221.

Figure 8:
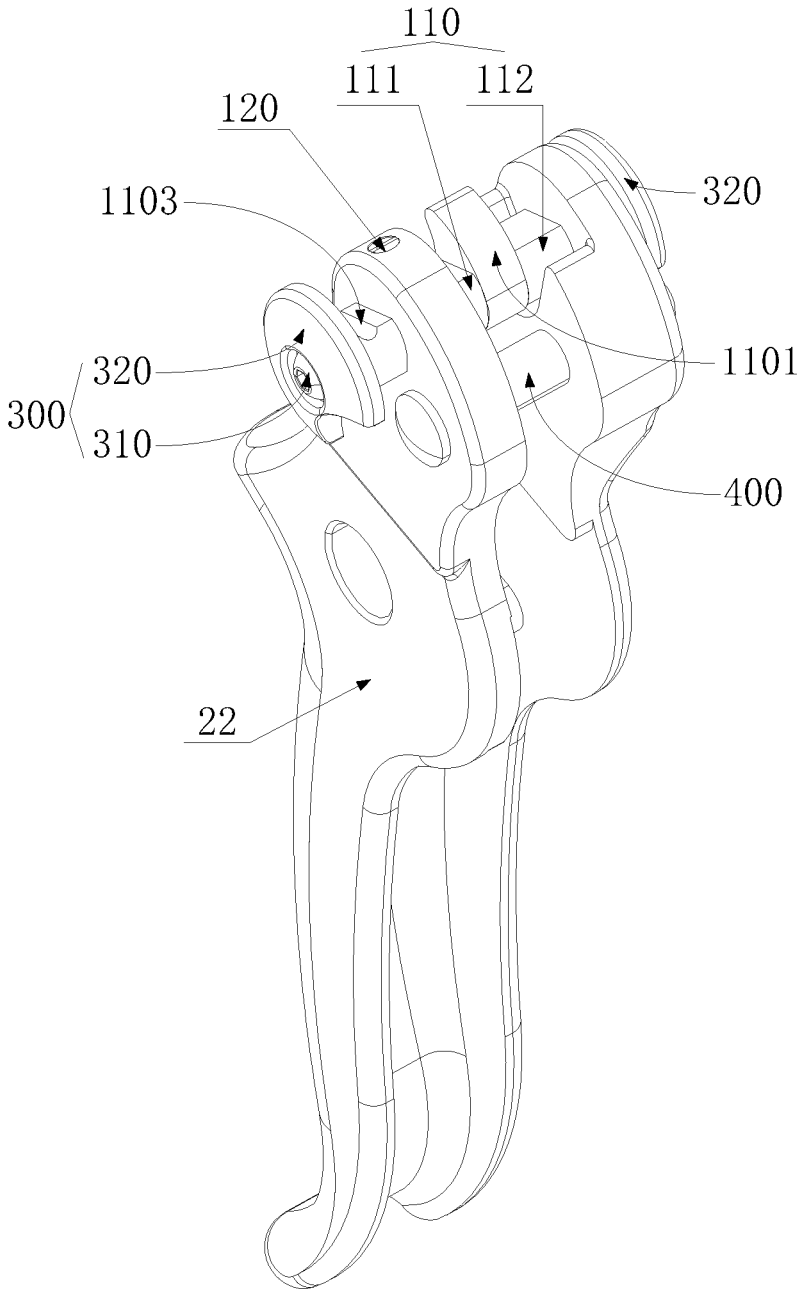
FIG. 8 is an isometric view of an assembly structure of a movable handle and a caulking amount adjusting assembly in the caulking gun handle in FIG. 3.

Referring to FIG. 9, in combination with FIG. 6 to FIG. 8, in the two kinds of caulking gun handles above provided in the present embodiment, preferably, but not limited to, as shown in FIG. 9 and FIG. 10, an end face of one end of the driving protrusion 1101 away from the driving shaft 110 is a circular arc surface, so as to avoid scratching the driving block 4 during contact between the driving protrusion 1101 and the driving block 4, further improving the service life of the caulking gun handle. And/or, preferably, but not limited to, one side of one handle mounting portion facing the other handle mounting portion is provided with an avoidance groove 223 for avoiding the driving shaft positioning member 120, so that in the second working condition in the foregoing, the driving shaft positioning member 120 is located in the avoidance groove 223, further the spacing between the two handle mounting portions of the movable handle 22 may be reduced, and the structural compactness of the caulking gun handle may be improved. In the above, "and/or" means that the two structures described in the above, namely, "an end face of one end of the driving protrusion 1101 away from the driving shaft 110 is a circular arc surface" and that "one side of one handle mounting portion facing the other handle mounting portion is provided with an avoidance groove 223 for avoiding the driving shaft positioning member 120", are provided simultaneously or alternatively.

Referring to FIG. 6 to FIG. 9, in some optional examples of the present embodiment, the above anti-release structures 300 provided at two ends of the driving shaft 110 each include a screw 310 and a baffle 320; the baffle 320 is sleeved over the screw 310, and one end of the screw 310 is inserted and threaded into a threaded hole provided in an end surface of the driving shaft 110.

Referring to FIG. 8, FIG. 9, FIG. 11, and FIG. 12, in some optional examples of the present embodiment, a pivot rotating shaft 400 is further connected between the two handle mounting portions of the movable handle 22, the pivot rotating shaft 400 penetrates through the first pivot rotating shaft mounting hole 232 in the top connector 23, one end of the pivot rotating shaft 400 is rotatably connected to one handle mounting portion 226, and the other end of the pivot rotating shaft 400 is rotatably connected to the other handle mounting portion.

Figure 11:
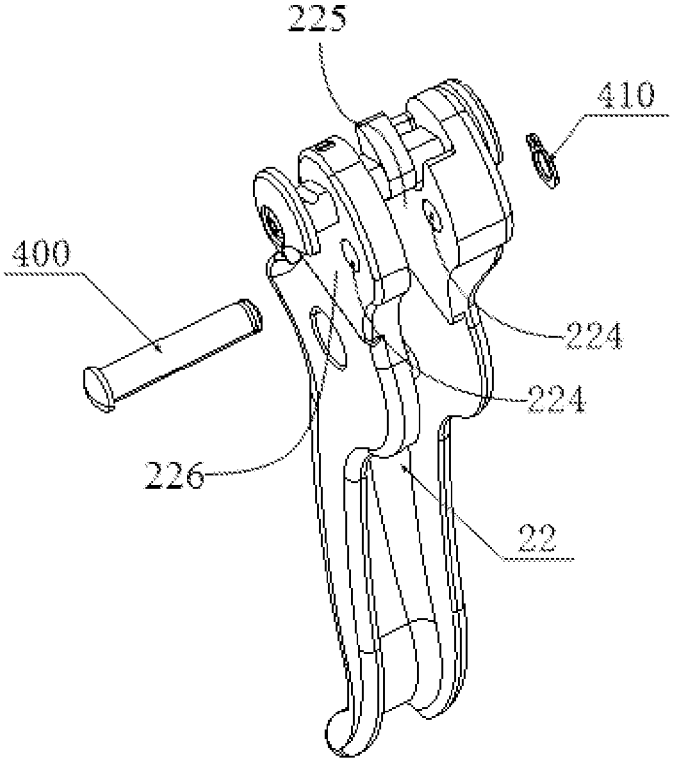
FIG. 11 is an exploded view of an assembly structure of the movable handle and a pivot rotating shaft in FIG. 8.
Figure 12:
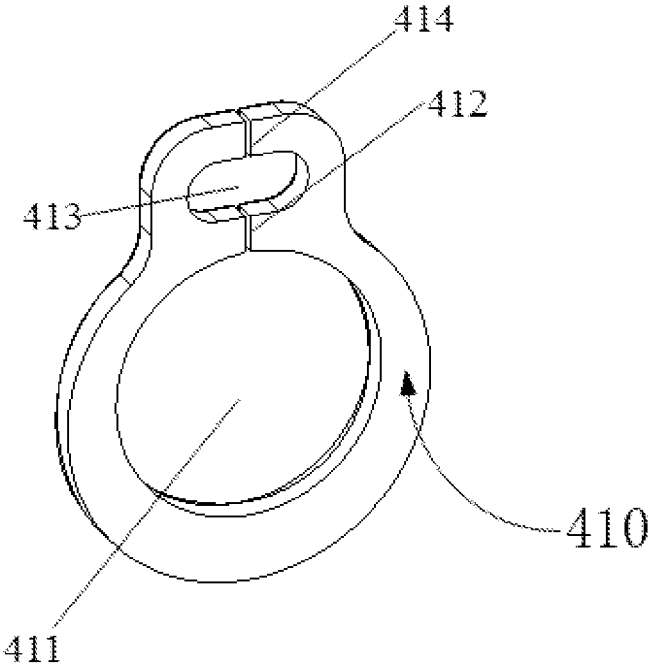
FIG. 12 is a schematic view of an overall structure of an end stopper provided at an end portion of the pivot rotating shaft in the caulking gun handle provided in an embodiment of the present disclosure.

In more detail, as shown in FIG. 11, the two handle mounting portions 226 are each provided with a second pivot rotating shaft mounting hole 224, wherein the pivot rotating shaft 400 includes a head portion 401 and a rod portion 402, and the rod portion 402 of the pivot rotating shaft 400 is blocked and locked by an end stopper 410 after sequentially penetrating through the second pivot rotating shaft mounting hole 224 in one handle mounting portion 226, the first pivot rotating shaft mounting hole 232 in the top connector 23, and the second pivot rotating shaft mounting hole 224 in the other handle mounting portion 226; alternatively, two ends of the pivot rotating shaft 400 are respectively blocked and locked by an end stopper 410, after the pivot rotating shaft 400 sequentially penetrates through the second pivot rotating shaft mounting hole 224 in one handle mounting portion 226, the first pivot rotating shaft mounting hole 232 in the top connector 23, and the second pivot rotating shaft mounting hole 224 in the other handle mounting portion 226. In the present embodiment, the structure of the end stopper 410 may be, but is not limited to, what is shown in FIG. 12, an elastic retaining ring, and the elastic retaining ring is provided with a first slit 412 in communication with a central opening 411, and a portion of the elastic retaining ring close to the first slit 412 extends upwards to a second slit 414 so as to form a hole 413, such that the elastic retaining ring can be conveniently opened. An end clamping groove is provided on a peripheral surface of an end portion of the pivot rotating shaft 400. In use, the elastic retaining ring is opened by using the first and second slits and the hole 413, and the elastic retaining ring is mounted in the end clamping groove of the pivot rotating shaft 400 in a sleeving way, realizing the function of locking the end portion of the pivot rotating shaft 400.

Certainly, in other optional examples of the present embodiment, the end stopper 410 further may adopt other structural forms, including but not limited to the configuration with reference to the anti-release structure 300 described in the preceding.

Embodiment 2

The present embodiment provides a caulking gun. Referring to FIG. 3 to FIG. 7, the caulking gun includes a barrel 3 and the caulking gun handle provided in any optional example in Embodiment 1.

As the caulking gun provided in the present embodiment includes the caulking gun handle described in Embodiment 1, the caulking gun provided in the present embodiment can achieve all the beneficial effects that can be achieved by the caulking gun handle in Embodiment 1, and the specific structure and achievable effects thereof may be obtained with reference to each optional example in Embodiment 1.

Finally, it should be noted that various embodiments in the present description are described in a progressive manner, each embodiment focuses on the differences from other embodiments, and the same or similar parts between various embodiments may refer to each other; various embodiments above in the present description are merely used for illustrating the technical solutions of the present disclosure, rather than limiting the present disclosure; although the detailed description is made to the present disclosure with reference to various preceding embodiments, those ordinarily skilled in the art should understand that they still could modify the technical solutions recited in various preceding embodiments, or make equivalent substitutions to some or all of the technical features therein; and these modifications or substitutions do not make the corresponding technical solutions essentially depart from the scope of the technical solutions of various embodiments of the present disclosure.

What is claimed is:

1. A caulking gun handle, comprising a top connector, a locking sheet, a caulking gun ejector rod, a driving block, a driving spring, a fixed handle, and a movable handle, wherein the locking sheet is obliquely hinged to a rear end of the top connector by a spring, the caulking gun ejector rod penetrates through the locking sheet and the top connector; the driving block is slidably connected to the caulking gun ejector rod; the driving spring is sleeved over the caulking gun ejector rod, one end of the driving spring abuts against a front end face of the driving block, and the other end of the driving spring is configured to abut against a barrel of a caulking gun; an upper end of the fixed handle is fixedly connected to a lower end of the top connector; an upper end of the movable handle is pivoted inside the top connector, and the movable handle is located in front of the fixed handle; and the driving block is hinged with the upper end of the movable handle or a lower end of the driving block abuts against a front side of the upper end of the movable handle, wherein the movable handle is provided with a caulking amount adjusting assembly;

the caulking amount adjusting assembly comprises a driving shaft and a driving shaft positioning member;

the upper end of the movable handle is provided with a mounting groove, portions at two sides of the mounting groove are each formed as a handle mounting portion, and the two handle mounting portions are provided at left and right sides of the top connector, respectively; the top connector is provided with a first pivot rotating shaft mounting hole that passes through the top connector in a left-right direction, the two handle mounting portions are respectively provided with a driving shaft mounting hole that passes through the handle mounting portions in the left-right direction, the driving shaft sequentially penetrates through the driving shaft mounting hole in one of the handle mounting portions, the first pivot rotating shaft mounting hole, and the driving shaft mounting hole in the other one of the handle mounting portions, two ends of the driving shaft are each provided with an anti-release structure, and the driving shaft is configured to rotate in synchronization with the two handle mounting portions;

a portion of the driving shaft is provided with a driving protrusion, a first positioning recess, and a second positioning recess, with the portion located at a peripheral surface of the driving shaft and between the two handle mounting portions; at least one of the handle mounting portions is provided with a positioning member mounting hole, the positioning member mounting hole is in communication with the driving shaft mounting hole, the driving shaft positioning member is mounted in the positioning member mounting hole, and one end of the driving shaft positioning member extends into the driving shaft mounting hole; and the driving shaft is configured to be slidable left and right with respect to the two handle mounting portions, so that in a first workstation, an end portion of the driving shaft positioning member located in the driving shaft mounting hole is engaged in the first positioning recess, and in a second workstation, the end portion of the driving shaft positioning member located in the driving shaft mounting hole is engaged in the second positioning recess, wherein with the driving shaft being in the first workstation, one end of the driving protrusion away from the driving shaft is capable of pressing the driving block forward while the driving shaft rotates forward; and with the driving shaft being in the second workstation, the driving protrusion avoids the driving block.

2. The caulking gun handle according to claim 1, wherein the driving shaft positioning member is a ball point screw, a ball point end of the ball point screw extends into the driving shaft mounting hole, and the positioning member mounting hole is a threaded hole.

3. The caulking gun handle according to claim 1, wherein the driving shaft comprises a main shaft and a shaft sleeve, the main shaft comprises a first shaft segment and a second shaft segment integrally connected with each other, and an outer circle diameter of a radial section of the first shaft segment is greater than an outer circle diameter of a radial section of the second shaft segment;

the first positioning recess and the second positioning recess are provided at a peripheral surface of the first shaft segment; the driving protrusion is cam-shaped, both the driving protrusion and the shaft sleeve are sleeved outside the second shaft segment, one side surface of the driving protrusion abuts against an end face of one end of the first shaft segment facing the second shaft segment, and the other side surface of the driving protrusion abuts against an end face of one end of the shaft sleeve facing the first shaft segment; and one end of the first shaft segment away from the second shaft segment is inserted in the driving shaft mounting hole of one of the handle mounting portions, one end of the second shaft segment away from the first shaft segment and one end of the shaft sleeve away from the first shaft segment are both inserted in the driving shaft mounting hole of the other one of the handle mounting portions, and the anti-release structure is configured to be able to prevent the driving shaft and the shaft sleeve from disengaging from the corresponding driving shaft mounting holes.

4. The caulking gun handle according to claim 3, wherein the peripheral surface of the driving shaft is provided with a plane, and the first positioning recess, the second positioning recess, and the driving protrusion are all provided at the plane; and a hole wall of the driving shaft mounting hole fits to and is matched with the peripheral surface of the driving shaft.

5. The caulking gun handle according to claim 4, wherein an end face of one end of the driving protrusion away from the driving shaft is a circular arc surface; and/or one side of one of the handle mounting portions facing the other one of the handle mounting portions is provided with an avoidance groove configured for avoiding the driving shaft positioning member.

6. The caulking gun handle according to claim 3, wherein an end face of one end of the driving protrusion away from the driving shaft is a circular arc surface; and/or one side of one of the handle mounting portions facing the other one of the handle mounting portions is provided with an avoidance groove configured for avoiding the driving shaft positioning member.

7. The caulking gun handle according to claim 1, wherein the driving protrusion is fixedly connected or integrally molded to a peripheral surface of one end of the driving shaft, and the first positioning recess and the second positioning recess are both provided at the driving protrusion; and the driving protrusion is inserted into the driving shaft mounting hole of one of the handle mounting portions, and an end of the driving shaft away from the driving protrusion is inserted into the driving shaft mounting hole of the other one of the handle mounting portions; and the anti-release structure is configured to be able to prevent the driving shaft and the driving protrusion from disengaging from the corresponding driving shaft mounting holes.

8. The caulking gun handle according to claim 7, wherein an end face of one end of the driving protrusion away from the driving shaft is a circular arc surface; and/or one side of one of the handle mounting portions facing the other one of the handle mounting portions is provided with an avoidance groove configured for avoiding the driving shaft positioning member.

9. The caulking gun handle according to claim 1, wherein the anti-release structure comprises a screw and a baffle, the baffle is sleeved over the screw, and one end of the screw is inserted and threaded into a threaded hole provided in an end surface of the driving shaft.

10. The caulking gun handle according to claim 1, wherein a pivot rotating shaft is further connected between the two handle mounting portions, the pivot rotating shaft penetrates through the first pivot rotating shaft mounting hole in the top connector, one end of the pivot rotating shaft is rotatably connected to one of the handle mounting portions, and the other end of the pivot rotating shaft is rotatably connected to the other one of the handle mounting portions.

11. The caulking gun handle according to claim 10, wherein the two handle mounting portions are each provided with a second pivot rotating shaft mounting hole; and the pivot rotating shaft comprises a head portion and a rod portion, and the rod portion of the pivot rotating shaft is blocked and locked by an end stopper after sequentially penetrating through the second pivot rotating shaft mounting hole in one of the handle mounting portions, the first pivot rotating shaft mounting hole in the top connector, and the second pivot rotating shaft mounting hole in the other one of the handle mounting portions; alternatively, two ends of the pivot rotating shaft are respectively blocked and locked by the end stopper after the pivot rotating shaft sequentially penetrates through the second pivot rotating shaft mounting hole in one of the handle mounting portions, the first pivot rotating shaft mounting hole in the top connector, and the second pivot rotating shaft mounting hole in the other one of the handle mounting portions.

12. The caulking gun handle according to claim 11, wherein the end stopper is an elastic retaining ring.

13. The caulking gun handle according to claim 12, wherein the elastic retaining ring is provided with a central opening, and a first slit, a hole, and a second slit in communication with the central opening, wherein a portion of the elastic retaining ring close to the first slit extends upwards to the second slit so as to form the hole.

14. A caulking gun, comprising a barrel and the caulking gun handle according to claim 1.

15. The caulking gun according to claim 14, wherein the driving shaft positioning member is a ball point screw, a ball point end of the ball point screw extends into the driving shaft mounting hole, and the positioning member mounting hole is a threaded hole.

16. The caulking gun according to claim 14, wherein the driving shaft comprises a main shaft and a shaft sleeve, the main shaft comprises a first shaft segment and a second shaft segment integrally connected with each other, and an outer circle diameter of a radial section of the first shaft segment is greater than an outer circle diameter of a radial section of the second shaft segment;

the first positioning recess and the second positioning recess are provided at a peripheral surface of the first shaft segment; the driving protrusion is cam-shaped, both the driving protrusion and the shaft sleeve are sleeved outside the second shaft segment, one side surface of the driving protrusion abuts against an end face of one end of the first shaft segment facing the second shaft segment, the other side surface of the driving protrusion abuts against an end face of one end of the shaft sleeve facing the first shaft segment; and one end of the first shaft segment away from the second shaft segment is inserted in the driving shaft mounting hole of one of the handle mounting portions, one end of the second shaft segment away from the first shaft segment and one end of the shaft sleeve away from the first shaft segment are both inserted in the driving shaft mounting hole of the other one of the handle mounting portions, and the anti-release structure is configured to be able to prevent the driving shaft and the shaft sleeve from disengaging from the corresponding driving shaft mounting holes.

17. The caulking gun according to claim 16, wherein the peripheral surface of the driving shaft is provided with a plane, and the first positioning recess, the second positioning recess, and the driving protrusion are all provided at the plane; and a hole wall of the driving shaft mounting hole fits to and is matched with the peripheral surface of the driving shaft.

18. The caulking gun according to claim 16, wherein an end face of one end of the driving protrusion away from the driving shaft is a circular arc surface; and/or one side of one of the handle mounting portions facing the other one of the handle mounting portions is provided with an avoidance groove configured for avoiding the driving shaft positioning member.

19. The caulking gun according to claim 14, wherein the driving protrusion is fixedly connected or integrally molded to a peripheral surface of one end of the driving shaft, and the first positioning recess and the second positioning recess are both provided at the driving protrusion; and the driving protrusion is inserted into the driving shaft mounting hole of one of the handle mounting portions, and an end of the driving shaft away from the driving protrusion is inserted into the driving shaft mounting hole of the other one of the handle mounting portions; and the anti-release structure is configured to be able to prevent the driving shaft and the driving protrusion from disengaging from the corresponding driving shaft mounting holes.

20. The caulking gun according to claim 14, wherein the anti-release structure comprises a screw and a baffle, the baffle is sleeved over the screw, and one end of the screw is inserted and threaded into a threaded hole provided in an end surface of the driving shaft.

* * * * *